US010065199B2

(12) United States Patent
Twaroski et al.

(10) Patent No.: US 10,065,199 B2
(45) **Date of Patent: *Sep. 4, 2018**

(54) FOAMING CARTRIDGE

(71) Applicant: GOJO Industries, Inc., Akron, OH (US)

(72) Inventors: Jacob Twaroski, Wattsburg, PA (US); Nick E. Ciavarella, Seven Hills, OH (US)

(73) Assignee: GOJO Industries, Inc., Akron, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/350,190

(22) Filed: Nov. 14, 2016

(65) Prior Publication Data

US 2017/0136475 A1 May 18, 2017

Related U.S. Application Data

(60) Provisional application No. 62/255,061, filed on Nov. 13, 2015.

(51) Int. Cl.

| | |
|---|---|
| ***A47K 5/14*** | (2006.01) |
| ***B05B 7/00*** | (2006.01) |
| ***B05B 15/00*** | (2018.01) |
| ***B05B 11/00*** | (2006.01) |
| ***B05B 15/20*** | (2018.01) |

(52) U.S. Cl.

CPC ..... *B05B 7/0062* (2013.01); *A47K 5/14* (2013.01); *B05B 11/0054* (2013.01); *B05B 11/3028* (2013.01); *B05B 15/002* (2013.01); *B05B 15/20* (2018.02)

(58) Field of Classification Search

CPC .... F04B 13/02; F04B 43/0045; F04B 43/025; F04B 43/026; F04B 43/04; F04B 53/10; F04B 43/02; F04B 45/04; F04B 7/0038; F04B 7/0233; F04B 7/0275; A47K 5/12;

(Continued)

(56) References Cited

U.S. PATENT DOCUMENTS 3,937,364 A * 2/1976 Wright ..... A45D 27/02 222/190
3,970,219 A * 7/1976 Spitzer ..... B65D 83/14 222/1

(Continued)

FOREIGN PATENT DOCUMENTS

CN 202370781 U 8/2012
CN 202493407 U 10/2012

(Continued)

OTHER PUBLICATIONS

Office Action for U.S. Appl. No. 15/355,112 dated Dec. 29, 2017.

(Continued)

*Primary Examiner* — Patrick M Buechner
(74) *Attorney, Agent, or Firm* — Calfee, Halter & Griswold LLP

(57) ABSTRACT

Foaming cartridge for use with a foam pump, refill unit or foam dispenser includes a housing and a foaming stage disposed within the housing. The foaming stage includes two or more mix media located within the foaming stage. At least two of the mix media are sponges and the sponges have different porosities.

20 Claims, 12 Drawing Sheets

(58) Field of Classification Search
CPC ..... A47K 5/14; A47K 5/16; B05B 11/3087; B05B 7/0018
See application file for complete search history.

(56) References Cited

U.S. PATENT DOCUMENTS 4,022,351 A * 5/1977 Wright ..... A45D 27/02 222/190
4,044,923 A * 8/1977 Gardner ..... B05B 7/0037 222/190
4,049,830 A 9/1977 Pugliese
4,184,615 A * 1/1980 Wright ..... A45D 27/02 222/190
4,219,159 A * 8/1980 Wesner ..... B05B 7/0062 239/343
4,274,594 A * 6/1981 Ito ..... B05B 7/0037 222/190
4,371,517 A 2/1983 Vanlerberghe
4,678,668 A 7/1987 Darras
4,801,249 A * 1/1989 Kakizawa ..... A61B 5/0235 417/269
4,940,702 A 7/1990 Finch
4,945,110 A 7/1990 Brokken
5,028,407 A 7/1991 Finch
5,063,249 A 11/1991 Andrews
5,129,550 A 7/1992 Eschbach
5,208,257 A 5/1993 Kabara
5,370,815 A 12/1994 Kessler
5,529,770 A 6/1996 McKinzie
5,534,266 A 7/1996 Ricketts
5,575,993 A 11/1996 Ward
5,616,348 A 4/1997 Winicov
5,635,469 A 6/1997 Fowler
5,720,984 A 2/1998 Ricketts
5,791,882 A 8/1998 Stucker et al.
5,842,607 A * 12/1998 Snider ..... A45D 27/10 222/145.6
5,843,912 A 12/1998 Hosmane
5,967,202 A 10/1999 Mullen
6,082,586 A 7/2000 Banks
6,264,438 B1 * 7/2001 Fukami ..... F04B 1/148 417/412
6,302,058 B1 10/2001 Dahl
6,382,928 B1 * 5/2002 Chang ..... F04B 43/026 417/269
6,544,539 B1 4/2003 Ricketts
6,871,679 B2 3/2005 Last
7,040,876 B2 5/2006 Fukami et al.
7,451,687 B2 * 11/2008 Lynn ..... F04B 1/146 74/60
7,647,954 B2 1/2010 Garber et al.
7,850,049 B2 12/2010 Ciavarella et al.
7,887,304 B2 * 2/2011 Cai ..... F04B 53/1065 417/271
8,272,539 B2 9/2012 Ophardt et al.
8,276,784 B2 * 10/2012 Ciavarella ..... A47K 5/14 222/66
8,304,375 B1 11/2012 Wolff
8,449,267 B2 * 5/2013 Pascual ..... F04B 43/0054 417/269
8,544,698 B2 10/2013 Ciavarella et al.
8,734,132 B2 * 5/2014 Brender a Brandis ... F04B 9/14 417/374
8,763,863 B2 7/2014 Quinlan et al.
8,820,585 B1 9/2014 Banks
8,845,309 B2 * 9/2014 Cai ..... F04B 43/026 137/510
8,955,718 B2 2/2015 Ciavarella et al.
8,960,498 B2 2/2015 Weglin et al.
9,341,176 B2 * 5/2016 Itahara ..... F04B 43/02
2002/0051717 A1 5/2002 Fukami
2003/0031571 A1 2/2003 Yamakawa
2003/0068234 A1 4/2003 Shindo
2003/0068242 A1 4/2003 Yamakawa
2004/0266649 A1 12/2004 Thekkekandam
2005/0049513 A1 * 3/2005 Hori ..... A61B 5/02 600/498
2005/0258192 A1 * 11/2005 Matthews ..... A47K 5/14 222/190
2006/0281663 A1 12/2006 Asmus
2007/0148101 A1 6/2007 Snyder
2007/0237901 A1 10/2007 Moses
2008/0051314 A1 2/2008 Wenzel
2009/0200340 A1 * 8/2009 Ophardt ..... A47K 5/16 222/190
2009/0294478 A1 * 12/2009 Ciavarella ..... A47K 5/14 222/190
2009/0317270 A1 * 12/2009 Reynolds ..... A47K 5/1208 417/410.1
2010/0051642 A1 * 3/2010 Wong ..... A47K 5/16 222/52
2010/0102083 A1 4/2010 Quinlan
2010/0270328 A1 10/2010 Quinlan
2012/0285992 A1 11/2012 Ciavarella et al.
2012/0309660 A1 12/2012 Kawasoe
2012/0315166 A1 12/2012 Looi et al.
2013/0017110 A1 * 1/2013 Villagomez ..... F04B 43/02 417/559
2013/0032614 A1 * 2/2013 Babikian ..... B01F 5/0693 222/190
2013/0056497 A1 * 3/2013 McNulty ..... A47K 5/1215 222/190
2013/0165530 A1 6/2013 Hillman
2013/0175296 A1 * 7/2013 Gray ..... A47K 5/1207 222/135
2013/0200098 A1 * 8/2013 Li ..... A47K 5/16 222/52
2013/0206794 A1 8/2013 McNulty et al.
2013/0233441 A1 * 9/2013 Ciavarella ..... B05B 7/0025 141/18
2014/0054322 A1 2/2014 McNulty et al.
2014/0054323 A1 2/2014 McNulty et al.
2014/0061246 A1 3/2014 McNulty
2014/0117053 A1 * 5/2014 Ciavarella ..... F04B 53/14 222/190
2014/0154117 A1 6/2014 Fukami
2014/0189992 A1 * 7/2014 Ganzeboom ..... A47K 5/1207 29/402.08
2014/0203047 A1 7/2014 McNulty
2014/0234140 A1 8/2014 Curtis et al.
2014/0243417 A1 8/2014 Modak
2014/0367419 A1 12/2014 Harris et al.
2015/0025156 A1 1/2015 Hillman
2015/0080478 A1 3/2015 Cohen
2015/0090737 A1 4/2015 Ciavarella
2015/0209811 A1 7/2015 Ophardt et al.
2015/0251841 A1 9/2015 McNulty et al.
2015/0266657 A1 9/2015 Corney
2015/0297728 A1 10/2015 Charboneau
2015/0320266 A1 * 11/2015 Creaghan ..... B05B 7/0037 222/190
2015/0337820 A1 11/2015 Cai
2016/0029855 A1 2/2016 Harris et al.
2016/0256016 A1 * 9/2016 Yang ..... A47K 5/14
2017/0135531 A1 * 5/2017 Mak ..... A47K 5/14

FOREIGN PATENT DOCUMENTS

CN 203570550 U 4/2014
CN 203867833 U 10/2014
CN 204003387 U 12/2014
EP 2135538 A1 12/2009
EP 3064114 A1 9/2016
TW 375133 U 3/2010
WO 2012154642 A1 11/2012
WO 2013126696 A2 8/2013

OTHER PUBLICATIONS

Office Action for U.S. Appl. No. 15/369,007 dated Dec. 29, 2017.
Office Action for U.S. Appl. No. 15/356,795 dated Jan. 12, 2018.

(56) References Cited

OTHER PUBLICATIONS

Notice of Allowance for U.S. Appl. No. 15/350,185 dated Dec. 13, 2017.
Notice of Allowance for U.S. Appl. No. 15/355,112 dated May 21, 2018.
Notice of Allowance for U.S. Appl. No. 15/369,007 dated May 22, 2018.
Notice of Allowance for U.S. Appl. No. 15/356,795 dated May 21, 2018.
Office Action for U.S. Appl. No. 15/429,389 dated Feb. 23, 2018.
Office Action for U.S. Appl. No. 15/480,711 dated Mar. 28, 2018.

* cited by examiner

FOAMING CARTRIDGE

RELATED APPLICATIONS

The present application claims the benefits of, and priority to, U.S. provisional application Ser. No. 62/255,061 filed on Nov. 13, 2015, and entitled improved foaming cartridge, which is incorporated herein by reference in its entirety.

TECHNICAL FIELD

The present invention relates generally to foam pumps, refill units for foam dispensers, and foam dispenser systems, and more particularly to foam pumps, refill units, and foam dispensers having an improved foam cartridge.

BACKGROUND OF THE INVENTION

Liquid dispenser systems, such as liquid soap and sanitizer dispensers, provide a user with a predetermined amount of liquid upon actuation of the dispenser. In addition, it is sometimes desirable to dispense the liquid in the form of foam by, for example, injecting air into the liquid to create a foamy mixture of liquid and air bubbles. Some liquids, such as, for example, alcohol-based liquids are difficult to foam and require enhanced mixing. Pumps for generating foam may form the foam by pumping a liquid and air mixture through a foam cartridge. Prior foam pumps and foam cartridges are disclosed in U.S. Published Patent Application No. 2014/0054323 filed on Mar. 9, 2013 and entitled Horizontal Pumps, Refill Units and Foam Dispensers with Integral Air Compressors, U.S. Pat. No. 8,955,718 filed on Mar. 18, 2013 and entitled Foam Pumps with Lost Motion and Adjustable Output Foam Pumps, U.S. Pat. No. 8,763,863 filed on Jul. 3, 2013 and entitled Bifurcated Foam Pump, Dispensers, and Refill Units, and U.S. Pat. No. 7,850,049 filed on Jan. 24, 2008 and entitled Foam Pump with Improved Piston Structure, all of which are incorporated herein by reference in their entirety.

SUMMARY

The present application discloses exemplary foaming cartridges for foam dispensers with an improved foam quality as compared to existing foam cartridges. Alcohol based products are difficult to foam because alcohol is a defoaming agent. Many of the prior art foam cartridges aid in foaming of alcohol based products, however the foam quality for the alcohol based products is not as good as, for example, the quality of foam in foamed soap products. Exemplary embodiments of improved foaming cartridges disclosed herein significantly improve the quality of foamed alcohol formulations. The improved alcohol foam exhibits reduced bubble size, more consistent bubble size, and is more stable. The foam cartridge includes a housing and a foaming stage disposed within the housing. The foaming stage includes two or more mix media, and at least two of the mix media are sponges that have different characteristics.

Exemplary embodiments of foaming cartridges, refill units and dispensers are disclosed herein. An exemplary foaming cartridge includes a housing and a foaming stage disposed within the housing. The foaming stage includes two or more mix media located within the foaming stage. At least two of the mix media are sponges and the sponges have different porosities.

An exemplary dispenser includes a housing, a motor, a foam pump, a foaming stage and an outlet for dispensing foam. The foam pump includes a wobble plate, a plurality of pump diaphragms wherein each pump diaphragm is connected to the wobble plate and a mixing chamber. The foaming stage includes two or more mix media located within the foaming stage. At least two of the mix media are sponges and have different porosities.

An exemplary foam dispenser includes a housing, a motor, a sequentially activated multi-diaphragm foam pump, a foam cartridge and a foam. The sequentially activated multi-diaphragm foam pump includes a liquid pump diaphragm for pumping liquid into a mixing chamber, a first air pump diaphragm for pumping air into the mixing chamber and a second air pump diaphragm for pumping air into the mixing chamber. The liquid pump diaphragm, the first air pump diaphragm and the second air pump diaphragm are compressed sequentially to pump liquid and air. The foam cartridge includes at least one foaming stage. The two or more mix media are located within the foaming stage. At least two of the mix media are sponges and the two sponges have different porosities.

DETAILED DESCRIPTION

The present application discloses exemplary embodiments for foaming cartridges for foam dispensers with improved foam quality. Exemplary embodiments of the improved foaming cartridge provides improved foam that exhibits reduced bubble size, more consistent bubble size, and is more stable. The foam cartridge includes a housing and a foaming stage disposed within the housing. Two or more mix media are located within the foaming stage, and at least two of the mix media are sponges having different characteristics. Some exemplary embodiments are especially well suited for foaming alcohol formulations.

Additionally, the present application discloses exemplary embodiments of sequentially activated multi-diaphragm foam pumps for use with the improved foaming cartridges. Some exemplary sequentially activated multi-diaphragm foam pumps combined with the improved foaming cartridge provide a higher quality foam with currently foaming alcohol then was previously obtainable with prior art foam pumps. Some exemplary embodiments include a wobble plate and three or more pump diaphragms. The three or more pump diaphragms include at least one liquid pump diaphragm and at least two air pump diaphragms. Each liquid pump diaphragm has a liquid inlet for receiving liquid, such as, for example, a soap, a sanitizer, or a lotion, and each air pump diaphragm has an air inlet for receiving ambient air. The three or more pump diaphragms operate sequentially, and each pump diaphragm operates once in an operating cycle. An operating cycle begins with the operation of a liquid pump diaphragm. Additionally, the sequentially activated multi-diaphragm foam pump includes a mixing chamber. Each liquid pump diaphragm pumps liquid into the mixing chamber, and each air pump diaphragm pumps ambient air into the mixing chamber. The liquid mixes with the ambient air in the mixing chamber to create a foam mixture that is dispensed out of the pump outlet. In some embodiments of the present invention, the foam mixture has an air to liquid ratio of about 2 to 1. In some embodiments, the air to liquid ratio is about 3 to 1.

The sequentially activated multi-diaphragm foam pumps may be used in foam dispensers. An exemplary foam dispenser comprises a housing, a motor, a refill unit, a sequentially activated multi-diaphragm foam pump, and a foam cartridge. The pump receives a foamable liquid from the refill unit, mixes the foamable liquid with ambient air to create a foam mixture, forces the foam mixture through the foam cartridge to enrich the foam, and dispenses the foam to a user.

Figure 1:
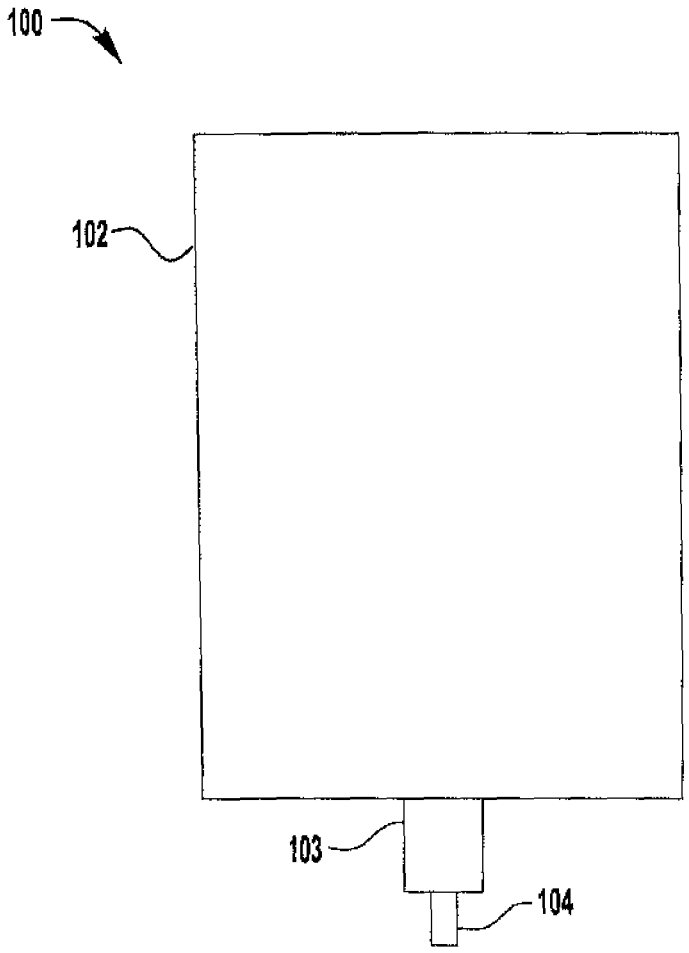
FIG. 1 is an exemplary embodiment of a refill unit for a foam dispenser.

FIG. 1 illustrates a refill unit 100 for a foam dispenser. The refill unit 100 includes a collapsible container 102. Collapsible container 102 includes a neck 103 and a drip-free quick connector 104. Exemplary drip-free quick connectors are disclosed in U.S. Pat. No. 6,871,679 titled Bag and Dispensing System Comprising Such A Bag, and U.S. Pat. No. 7,647,954 titled Connector Apparatus And Method For Connecting The Same For Controlling Fluid Dispensing, which are incorporated herein by reference in their entirety. Disposable refill units contain a supply of a foamable liquid. In various embodiments, the contained foamable liquid could be for example a soap, a sanitizer, a cleanser, a disinfectant, a lotion or the like. The container is a collapsible container and can be made of thin plastic or a flexible bag-like material. In other embodiments, the container may be a non-collapsing container formed by a rigid housing member, or any other suitable configuration for containing the foamable liquid without leaking. In the case of a non-collapsing container, a vent system may be included. Exemplary venting systems are disclosed in U.S. Patent Applications Publication No. 2015/0266657 titled Closed system for venting a dispenser reservoir; Publication No. 2015/025184 titled Pumps With Container Vents and application Ser. No. 14/811,995, titled Vented Refill Units And Dispensers Having Vented Refill Units, which are incorporated herein by reference.

Figure 2:
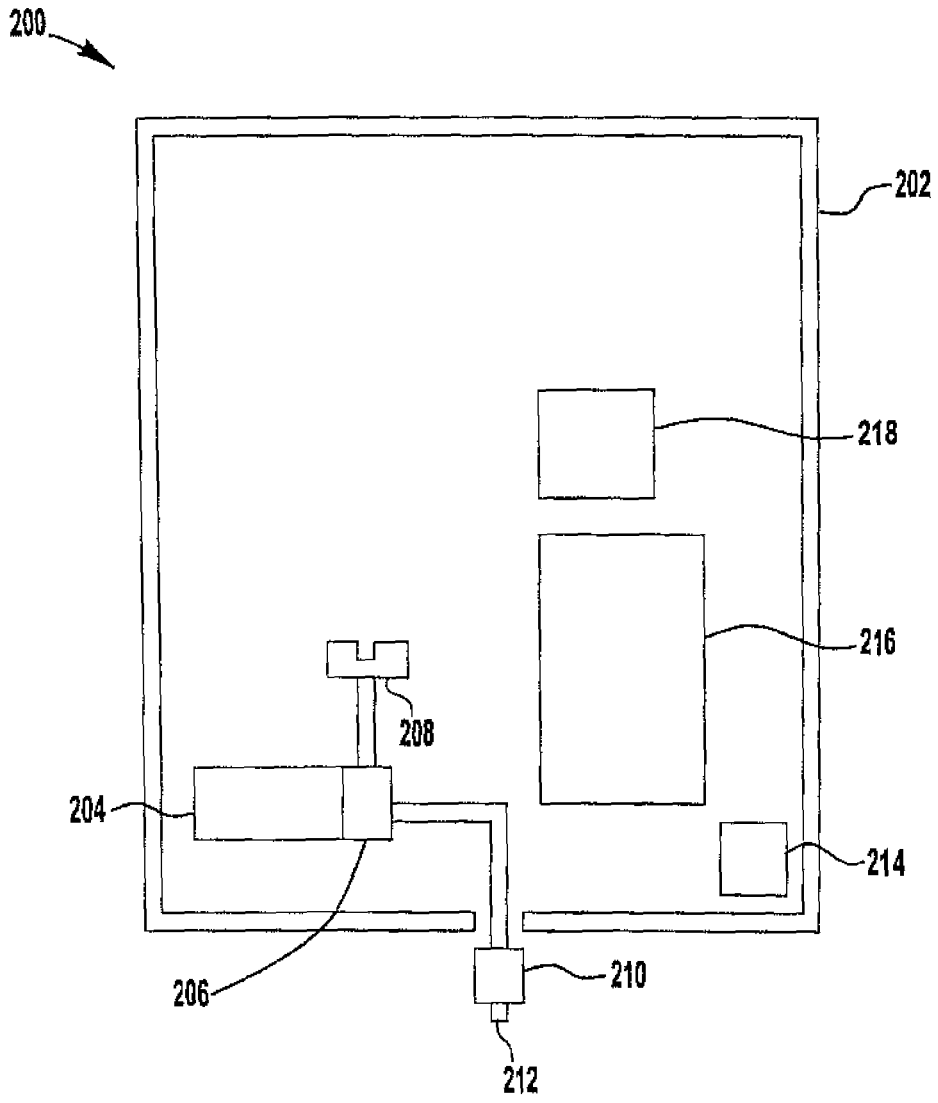
FIG. 2 is an exemplary embodiment of a foam dispenser.
Figure 2A:
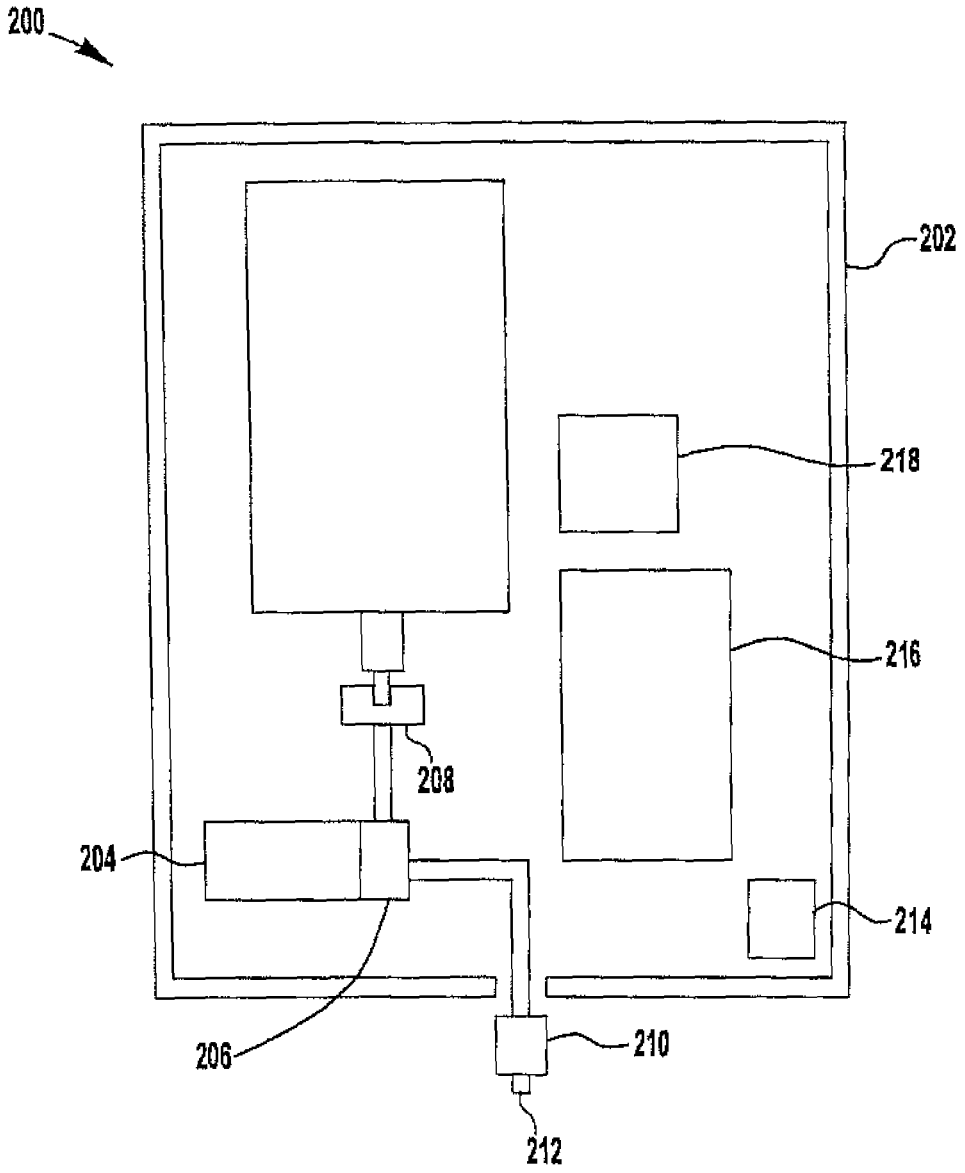
FIG. 2A is the exemplary foam dispenser of FIG. 2 with the exemplary refill unit of FIG. 1 installed.

FIG. 2 illustrates an exemplary embodiment of a touch-free foam dispenser 200. The touch-free foam dispenser 200 includes a housing 202, a motor 204, a foam pump 206, a refill unit connector 208, a foam cartridge 210, and a nozzle 212. Exemplary embodiments of foam cartridges 210 are shown and described below with respect to FIG. 13. A refill unit 100 may be connected to the refill unit connector 208 as shown in FIG. 2A. The refill unit 100 contains a foamable liquid, such as a soap, a sanitizer, a lotion, a cleanser, a disinfectant or the like. The touch-free foam dispenser 200 is activated when sensor 214 detects the presence of a user or object. Upon detection of an object or user, the sensor 214 provides a signal to the processor (not shown) in the electronic control board 216. The electronic control board 216 provides an output signal that causes the motor 204 to rotate an eccentric wobble plate actuator drive mechanism 301. The sensor 214 and the electronic control board 216 receive power from a power source 218. In some embodiments, the motor 204 receives power from the power source 218, and, in other embodiments, the refill unit includes a power source (not shown) that provides power to a rechargeable power source (not shown). Exemplary embodiments of refill units with power supplies that provide power to the wobble plate actuator drive mechanism 301 are shown and described in U.S. Publication No. 2014/0234140 titled Power Systems For Touch Free Dispensers And Refill Units Containing A Power Source, which is incorporated herein in its entirety by reference. Providing power to the motor 204 causes wobble plate actuator drive mechanism 301 to rotate. Rotation of wobble plate actuator drive mechanism 301 sequentially compresses and expands the diaphragms of foam pump 206 and pumps liquid and ambient air into mixing chamber. The liquid and air mix together and form a foam mixture. The foam mixture is forced through the foam cartridge 210, which creates a rich foam. The rich foam is dispensed from the foam dispenser 200 through the nozzle 212.

The refill unit 100 and the foam dispenser 200 illustrated in FIGS. 1 and 2, respectively, are drawn generically because a variety of different components may be used for many of the refill unit 100 and the foam dispenser 200. Although foam pump 206 is illustrated generically above, it is described in detail below. Some exemplary dispenser components that may be used in accordance with the present invention are shown and described in U.S. Pat. No. 8,960,498 titled Touch-Free Dispenser With Single Cell Operation And Battery Banking; U.S. Pat. Pub. No. 2014/00543.22 titled Off-Axis Inverted Foam Dispensers And Refill Units and Pub. No. 2014/0234140 titled Power Systems For Touch Free Dispensers And Refill Units Containing A Power Source, which are incorporated herein by reference in their entirety.

Figure 3:
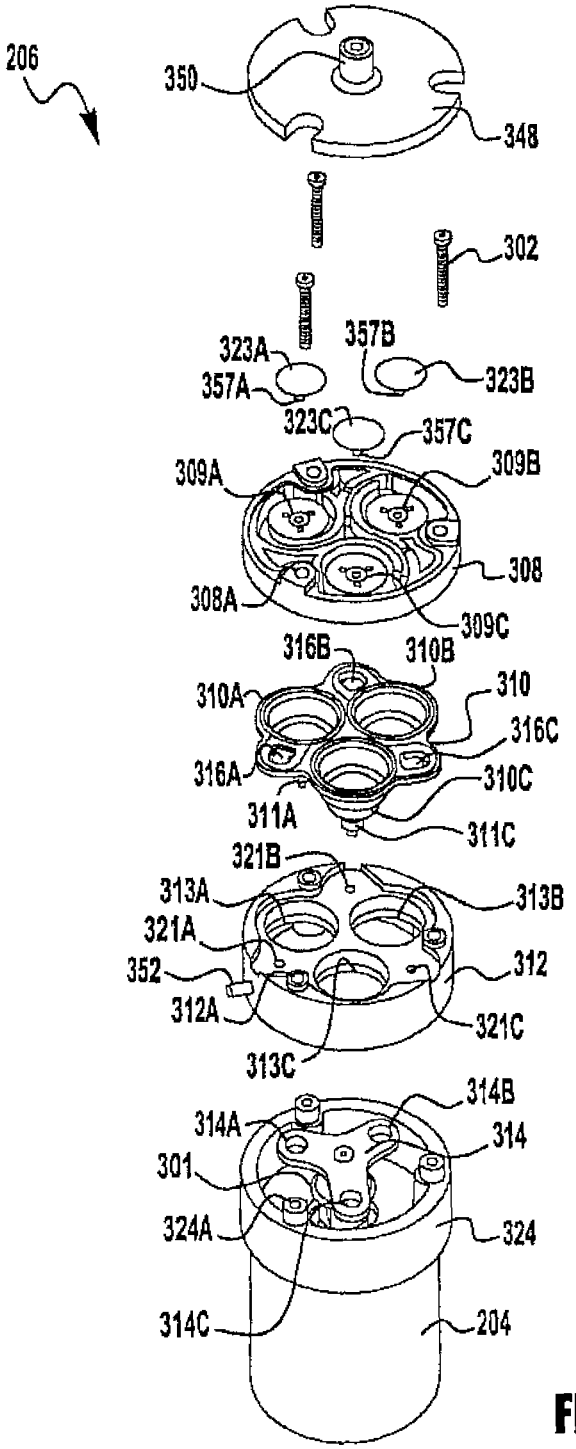
FIG. 3 is an exploded view of an exemplary embodiment of a sequentially activated multi-diaphragm foam pump taken from a first perspective.

FIG. 3 is an exploded view of an exemplary embodiment of foam pump 206. Foam pump 206 is driven by motor 204. Foam pump 206 includes a pump base 324, a wobble plate 314, a diaphragm assembly seat 312, a diaphragm assembly 310, a valve seat 308, outlet valves 323A, 323B, 323C, screws 302, and a cover 348. The valve seat 308, diaphragm assembly seat 312, and pump base 324 are secured together by screws 302 in screw holes 308A, 312A, 324A. The cover 348 is attached to the valve seat 308. Outlet valves 323A, 323B 323C are secured to and seated in the valve seat 308.

The diaphragm assembly 310 includes three pump diaphragms 310A, 310B, 310C, and each pump diaphragm 310A, 310B, 310C has a connector 311A, 311B, 311C. The diaphragm assembly 310 is located in the diaphragm assembly seat 312. The pump diaphragms 310A, 310B, 310C are disposed in the receiving holes 313A, 313B, 313C of the diaphragm assembly seat 312, and the three connectors 311A, 311B, 311C connect to the wobble plate 314 by inserting the three connectors 311A, 311B, 311C in the three wobble plate holes 314A, 314B, 314C.

Ambient air enters the foam pump 206 through pump air inlet 424B (FIG. 4), and liquid, such as for example, foamable soap or sanitizer enters the foam pump 206 through liquid inlet 352. Two of the pump diaphragms 310B, 310C receive ambient air, and the other pump diaphragm 310A receives foamable liquid, such as, for example soap or sanitizer.

Figure 4:
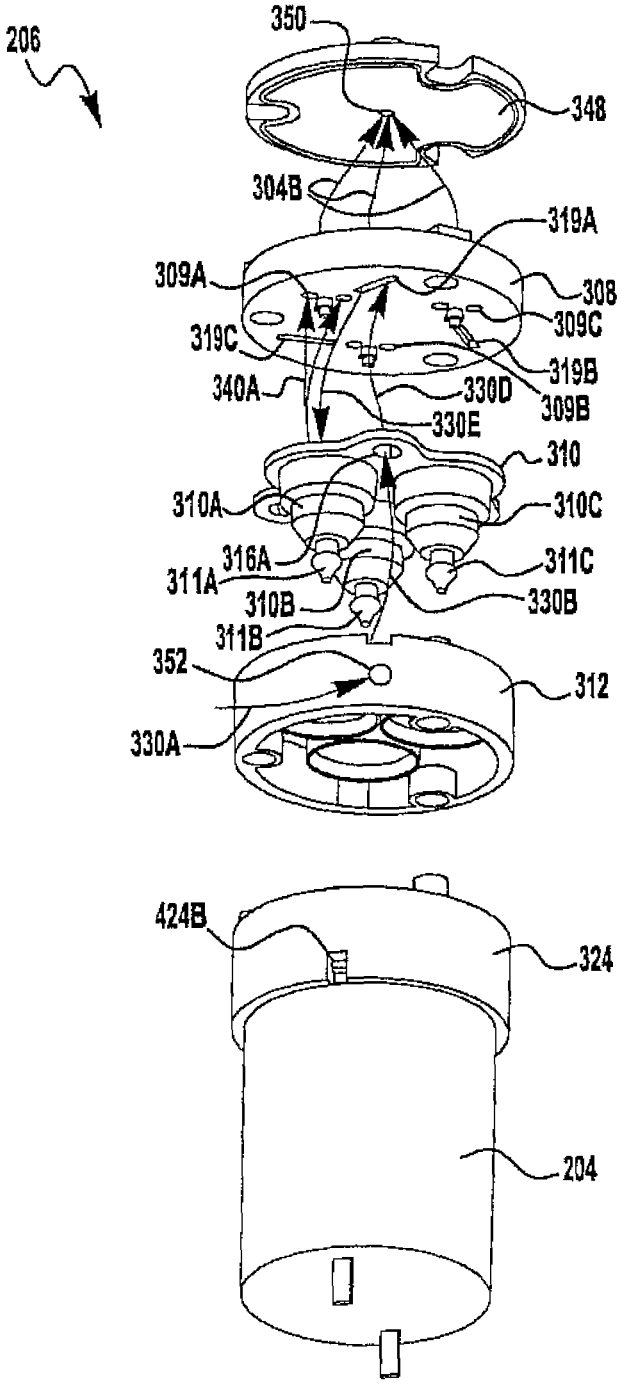
FIG. 4 is an exploded view of the exemplary embodiment of the sequentially activated multi-diaphragm foam pump of FIG. 3 taken from a second perspective.

FIG. 4 is another exploded view of the exemplary foam pump 206 from a different perspective. As described above, the diaphragm assembly 310 includes three pump diaphragms 310A, 310B, 310C. Each pump diaphragm 310A, 310B, 310C has a corresponding inlet valve 316A, 316B, 316C (better seen in FIGS. 5 and 6). FIG. 4 also provides a view of the bottom of the valve seat 308. The bottom of valve seat 308 has three areas that correspond to the three pump diaphragms 310A, 310B, 310C. Each area has three fluid outlet apertures 309A, 309B, 309C that extend through valve seat 308, a valve stem retention aperture 329A, 329B, 329C (FIG. 7), and a fluid inlet groove 319A, 319B, 319C. The fluid inlet grooves 319A, 319B, 319C do not extend through valve seat 308.

Figure 5:
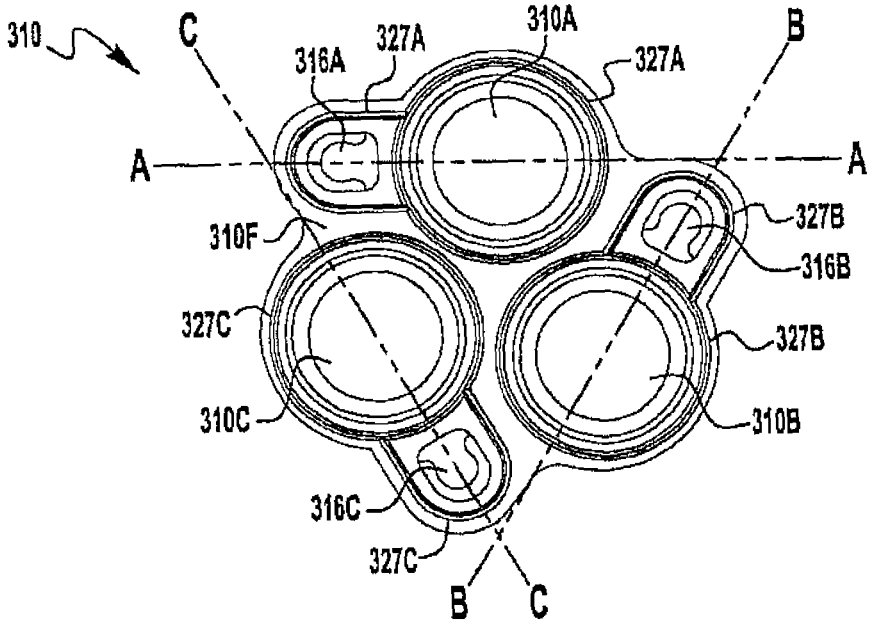
FIG. 5 is a top view of an exemplary diaphragm assembly for the exemplary embodiment of the sequentially activated multi-diaphragm foam pump of FIG. 3.
Figure 6:
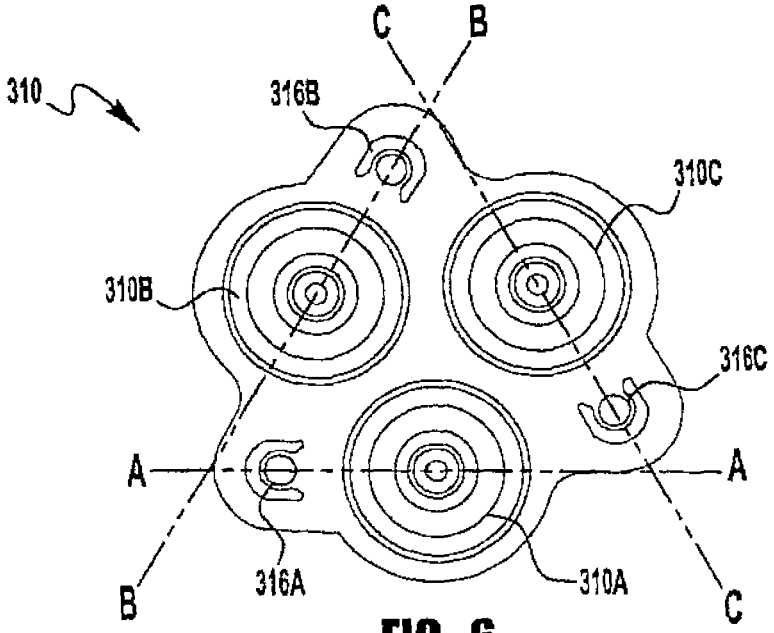
FIG. 6 is a bottom view of the exemplary diaphragm assembly for the exemplary embodiment of the sequentially activated multi-diaphragm foam pump.

FIGS. 5 and 6 illustrate a top view and a bottom view, respectively, of the exemplary diaphragm assembly 310 for foam pump 206. In some embodiments, the diaphragm assembly is made of natural rubber, EPDM, Silicone, Silicone rubber TPE, TPU, TPV, vinyl, or the like. The diaphragm assembly 310 includes three molded pump diaphragms 310A, 310B, 310C and three corresponding inlet valves 316A, 316B, 316C. The top of the diaphragm assembly 310 acts as a sealing gasket. The top of the diaphragm assembly 310 has a flat section 310F, and each pump diaphragm 310A, 310B, 310C has gasket walls 327A, 327B, 327C that surround the respective valves 316A, 316B, 316C and pump diaphragms 310A, 310B, 310C. The gasket walls 327A, 327B, 327C seal against the bottom of the valve seat 308 (FIG. 4 and FIG. 8) to prevent fluid, such as, air and liquid soap or sanitizer from leaking out of the foam pump 206 at a location other than the pump outlet 350 (FIG. 3). One-way inlet valves 316A, 316B, 316C allow ambient air, liquid soap, or sanitizer to enter the pump diaphragms 310A, 310B, 310C when the pump diaphragms 310A, 310B, 310C have a negative pressure (i.e., when the pump diaphragms 310A, 310B, 310C are expanding), and seal against inlet apertures 321A, 321B, 321C when the pump diaphragms 310A, 310B, 310C have a positive pressure (e.g. when the pump diaphragms 310A, 310B, 310C are compressing). The one-way inlet valves 316A, 316B, 316C are formed by flexible tabs and are made of the same material as the diaphragm assembly 310.

Figure 7:
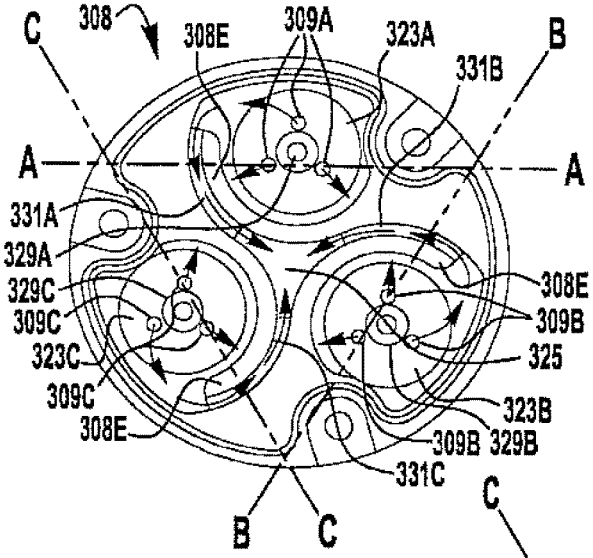
FIG. 7 is a top view of an exemplary valve seat for the exemplary embodiment of the sequentially activated multi-diaphragm foam pump of FIG. 3.

FIG. 7 is a top view of an exemplary valve seat 308 for the foam pump 206. One-way liquid outlet valve 323A is shown transparently to more clearly illustrate the flow of liquid 331A through liquid outlet apertures 309A and into mixing chamber 325. One-way liquid outlet valve 323A includes a valve stem 357A (FIG. 3) that is inserted into aperture 329A to secure one-way liquid outlet valve 323A to valve seat 308. One-way liquid outlet valve 323A is normally closed and prevents air or liquid from flowing from the mixing chamber 325, back through liquid outlet apertures 309A, and into liquid pump diaphragm 310A. One-way liquid outlet valve 323 opens when liquid pump diaphragm 310A is being compressed to pump fluid.

Similarly, one-way air outlet valves 323B, 323C are shown transparently to more clearly illustrate the flow of air 331B, 331C through air outlet apertures 309B, 309C and into mixing chamber 325. One-way air outlet valves 323B, 323C each include a valve stem 357B, 357C (FIG. 3) that are inserted into corresponding apertures 329B, 329C to secure the one-way air outlet valves to valve seat 308. One-way air outlet valves 323B, 323C are normally closed and prevent air or liquid from flowing from the mixing chamber 325, back through air outlet apertures 323B, 323C, and into air pump diaphragms 310B, 310C. One-way air outlet valves 323B, 323C open when corresponding air pump diaphragms 310B, 310C are being compressed to pump air.

The valve seat 308 also includes flow directional control walls 308E. The flow directional control walls 308E provide flow paths that aid in the mixing of liquid and air. In this embodiment the flow directional control walls 308E are curved and cause the liquid and air to intersect in a tangential relationship. In some embodiments, flow directional control walls 308E are designed and arranged to cause the liquid an air to intersect at a desired angle, such as, for example, each flow path may intersect at a 120 degree angle. In some embodiments, the flow directional control walls 308E are arranged so that the two air paths intersect the liquid flow path at about 180 degrees. The design of the flow path intersection may be different for different types of liquids, for example, a higher quality of foam may be obtained by causing the liquid soap to be intersected head on (180 degrees) by the two air flow paths, while a higher quality foam may be obtained for foamable sanitizer by having the air paths tangentially intersect with the liquid path.

Figure 8:
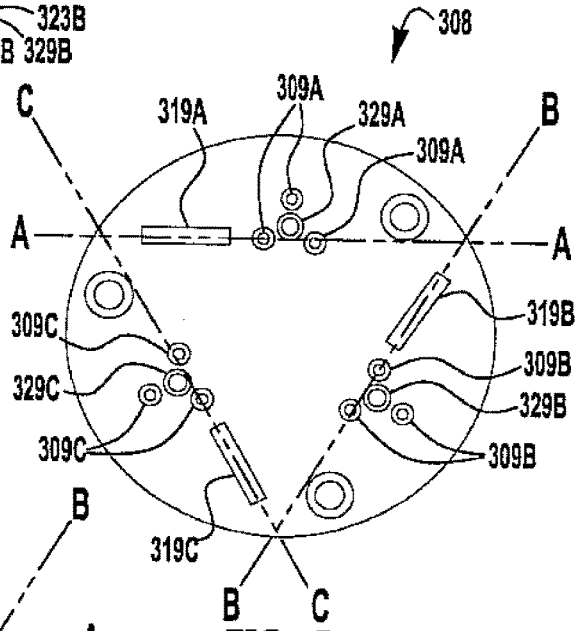
FIG. 8 is a bottom view of the exemplary valve seat of FIG. 7.

FIG. 8 is a bottom view of the exemplary valve seat 308 for the foam pump 206. The valve seat 308 includes three liquid outlet apertures 309A that pass through valve seat 308 and a liquid outlet valve aperture 329A for retaining one-way liquid outlet valve 323A. Valve seat 308 also includes a liquid inlet groove 319A that extends partially into valve seat 308 to provide a liquid path from one-way liquid inlet valve 316A to the interior of liquid pump diaphragm 310A. In addition, the valve seat 308 includes a first set of three air outlet apertures 309B that pass through valve seat 308, and a second set of three air outlet apertures 309C that pass through valve seat 308. Also, valve seat 308 includes air outlet valve apertures 329B, 329C for retaining one-way air outlet valves 323B, 323C, and air inlet grooves 319B, 319C that extend partially into valve seat 308 to provide an air path from one-way air inlet valves 316B, 316C to the interior of air pump diaphragms 310B, 310C.

Figure 9:
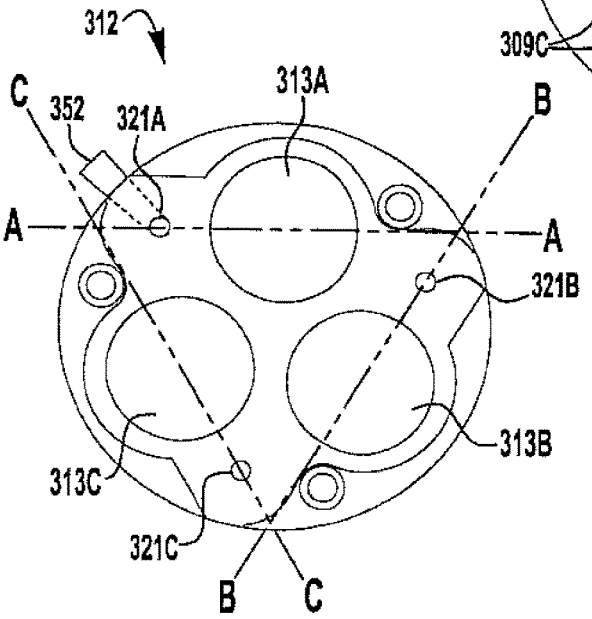
FIG. 9 is a top view of an exemplary diaphragm assembly seat for the exemplary embodiment of the sequentially activated multi-diaphragm foam pump of FIG. 3.

FIG. 9 is a top view of an exemplary diaphragm assembly seat 312 for the exemplary embodiment of a foam pump 206. The diaphragm assembly seat 312 includes three receiving holes 313A, 313B, 313C and three inlet apertures 321A, 321B, 321C. In fluid communication with inlet aperture 321A is liquid inlet 352 which may be coupled to the liquid outlet of container 102. Each receiving hole 313A, 313B, 313C is sized to receive a diaphragm 310A, 310B, 310C. Each inlet aperture 321A, 321B, 321C extends through diaphragm assembly seat 312 and allows either ambient air, liquid soap, or sanitizer to enter one of the diaphragms 310A, 310B, 310C.

Figure 10A:
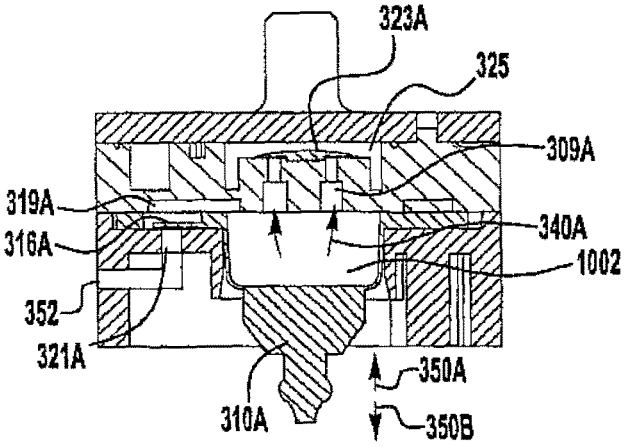
FIG. 10A is a cross-sectional view taken along the lines A-A of FIGS. 5-9 of a liquid pump portion of the sequentially activated multi-diaphragm foam pump.

FIG. 10A is a cross-sectional view taken along the lines A-A of FIGS. 5-9 showing the liquid pump portion of foam pump 206. In operation, liquid pump diaphragm 310A is moved downward, as shown by reference number 350B, to expand pump chamber 1002, which causes liquid inlet valve 316A to open allowing liquid to be drawn into pump chamber 1002 through liquid inlet 352, inlet aperture 321A, and liquid inlet groove 319A. Once the pump chamber 1002 is expanded it is primed with liquid, such as, for example, liquid soap or sanitizer. When the liquid pump diaphragm 310A is compressed (i.e. the liquid pump diaphragm 310A moves in the direction shown by reference number 350A), the liquid is pumped in the direction shown by reference number 340A. The liquid travels through liquid outlet apertures 309A, past one-way liquid outlet valve 323A and into mixing chamber 325. One-way liquid outlet valve 323A is normally closed, but one-way liquid outlet valve 323A opens due to pressure caused by compressing liquid pump chamber 1002. One-way liquid outlet valve 323A prevents air or liquid from flowing back through liquid outlet apertures 309A and into liquid pump diaphragm 310A. Subsequently, the liquid pump diaphragm 310A begins to expand, which starts the process again by causing liquid inlet valve 316A to open, and liquid is drawn into liquid pump chamber 1002 through liquid inlet aperture 321A and liquid inlet groove 319A. A operating cycle of foam pump 206 includes one pump of liquid from liquid pump diaphragm 310A through liquid outlet apertures 309A, past liquid outlet valve 323A, and into mixing chamber 325 (FIG. 7) (followed by two pumps of air as described below).

Figure 10B:
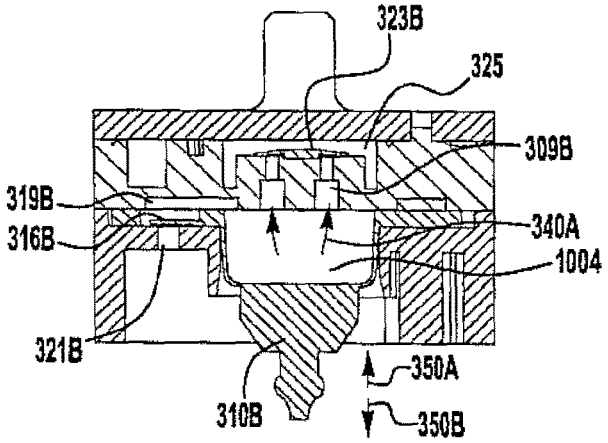
FIG. 10B is a cross-sectional view taken along the lines B-B of FIGS. 5-9 of an air pump portion of the sequentially activated multi-diaphragm foam pump.
Figure 10C:
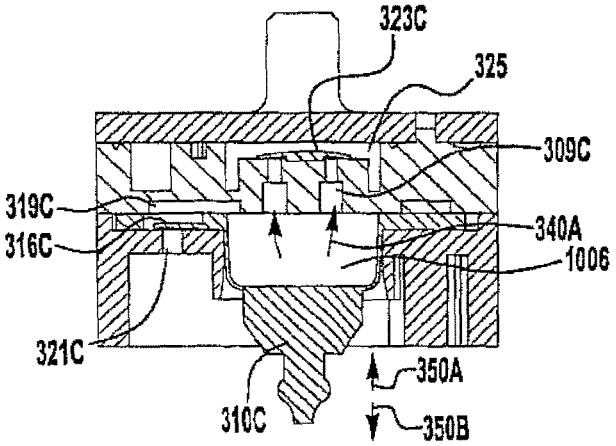
FIG. 10C is a cross-sectional view taken along the lines C-C of FIGS. 5-9 of a second air pump portion of the sequentially activated multi-diaphragm foam pump.

FIGS. 10B and 10C are a cross-sectional view taken along the lines B-B and C-C, respectively, of FIGS. 5-9 showing the air pump portions of foam pump 206. In operation, air pump diaphragms 310B, 310C are moved downward, as shown by reference number 350B, to expand air pump chambers 1004, 1006, which causes air inlet valves 316B, 316C to open allowing ambient air to be drawn into pump chambers 1004, 1006 through air inlet apertures 321B, 321C and air inlet grooves 319B, 319C. Once the pump chambers 1004, 1006 are primed with air, the air pump diaphragms 310B, 310C may be compressed (moved in the direction shown by reference number 350A). Compression of air pump diaphragms 310B, 310C pump the air in the direction shown by reference number 340A. The air travels through air outlet apertures 309B, 309C, past one-way air outlet valves 323B, 323C, and into mixing chamber 325 to mix with the foamable liquid. One-way air outlet valves 323B, 323C are normally closed, but one-way air outlet valves 323B, 323C open due to pressure caused by compressing air pump chambers 1004, 1006. One-way air inlet valves 323B, 323C prevent air or liquid from flowing back through air outlet apertures 309B, 309C and into air pump diaphragms 310B, 310C. Subsequently, the air pump diaphragms 310B, 310C begin to expand, which starts the process again by causing air inlet valves 316B, 316C to open, and ambient air is drawn into air pump chambers 1004, 1006 through air inlet apertures 321B, 321C and air inlet grooves 319B, 319C. An operating cycle of foam pump 206 includes one pump of liquid (as described above) followed by one pump of air from air pump diaphragm 310B through air outlet apertures 309B, past air outlet valve 323B, and into mixing chamber 325 (FIG. 7). In addition, an operating cycle of foam pump 206 includes one pump of ambient air from air pump diaphragm 310C through air outlet apertures 309C, past air outlet valve 323C, and into mixing chamber 325 (FIG. 7).

The diaphragms 310A, 310B, 310C operate sequentially, in which one sequence of operation includes one pump of liquid, such as, for example, soap or sanitizer, or ambient air by each of the three pump diaphragms 310A, 310B, 310C. The order of operation of the pump diaphragms 310A, 310B, 310C is dependent upon the configuration of the wobble plate 314 (FIG. 3). As shown in FIG. 3, each pump diaphragm 310A, 310B, 310C has a connector 311A, 311B, 311C, and the three pump diaphragms 310A, 310B, 310C connect to the wobble plate 314 by inserting the three connectors 311A, 311B, 311C in the three wobble plate links 314A, 314B, 314C. Wobble plate 314 connects to an eccentric wobble plate actuator that causes the wobble plate 314 to undulate. As the wobble plate 314 undulates, the wobble plate links 314A, 314B, 314C move in upward and downward motions. The upward motion causes the pump diaphragms 310A, 310B, 310C to compress, and the downward motion causes the pump diaphragms 310A, 310B, 310C to expand. The configuration of the wobble plate 314 causes one pump diaphragm 310A, 310B, 310C to compress at a time, which causes the pump diaphragms 310A, 310B, 310C to pump sequentially. The configuration of the wobble plate 314 also causes one pump diaphragm 310A, 310B, 310C to expand at a time, which causes the pump diaphragms 310A, 310B, 310C to prime sequentially. In the exemplary sequence of operation, the liquid pump diaphragm 310A pumps a shot of fluid, followed by air pump diaphragm 310B pumping a shot of air, and the sequence of operation ends with air pump diaphragm 310C pumping a second shot of air. The sequence may be repeated any number of times depending on the desired output dose of foam. The air from the air pump diaphragms 310B, 310C mixes with either the liquid or sanitizer from the liquid pump diaphragm 310A in the mixing chamber 325 (FIG. 7), which creates a foam mixture. The foam mixture exits the foam pump 206 through the pump outlet 350.

FIG. 4 illustrates the flow path of the liquid soap or sanitizer through the exploded view. When the liquid pump diaphragm 310A expands, liquid enters the foam pump 206 through liquid inlet 352, which is shown by reference number 330A. The liquid travels through aperture 321A in the diaphragm assembly seat 312, and past liquid one-way inlet valve 316A, as shown by reference number 330B. Inlet valve 316A opens, the liquid travels through groove 319A and into liquid pump diaphragm 310A, which is shown by reference numbers 330D and 330E.

The liquid pump diaphragm 310A compresses and pumps the liquid through liquid outlet aperture 309A, past one-way liquid outlet valve 323A, and into the mixing chamber 325 (FIG. 7), which is shown by reference number 340A. Air follows a similar path for air pump diaphragms 310B, 310C. When air pump diaphragms 310B, 310C expand, air is drawn into air inlet 424B, travels through apertures 321B, 321C (FIG. 9) in diaphragm seat assembly 312, travels through one-way air inlet valves 316B, 316C (FIGS. 5 and 6), travels into grooves 319B, 319C, in the bottom of valve seat 308, and travels into air pump diaphragms 310B, 310C. When air pump diaphragms 310B, 310C compress, air is forced through apertures 309B, 309C, past one-way air outlet valves 323B, 323C (FIG. 7), and into mixing chamber 325 where it mixes with the liquid to form a foam mixture. The foam mixture is dispensed through outlet 350, which is shown by reference number 304B.

Figure 11:
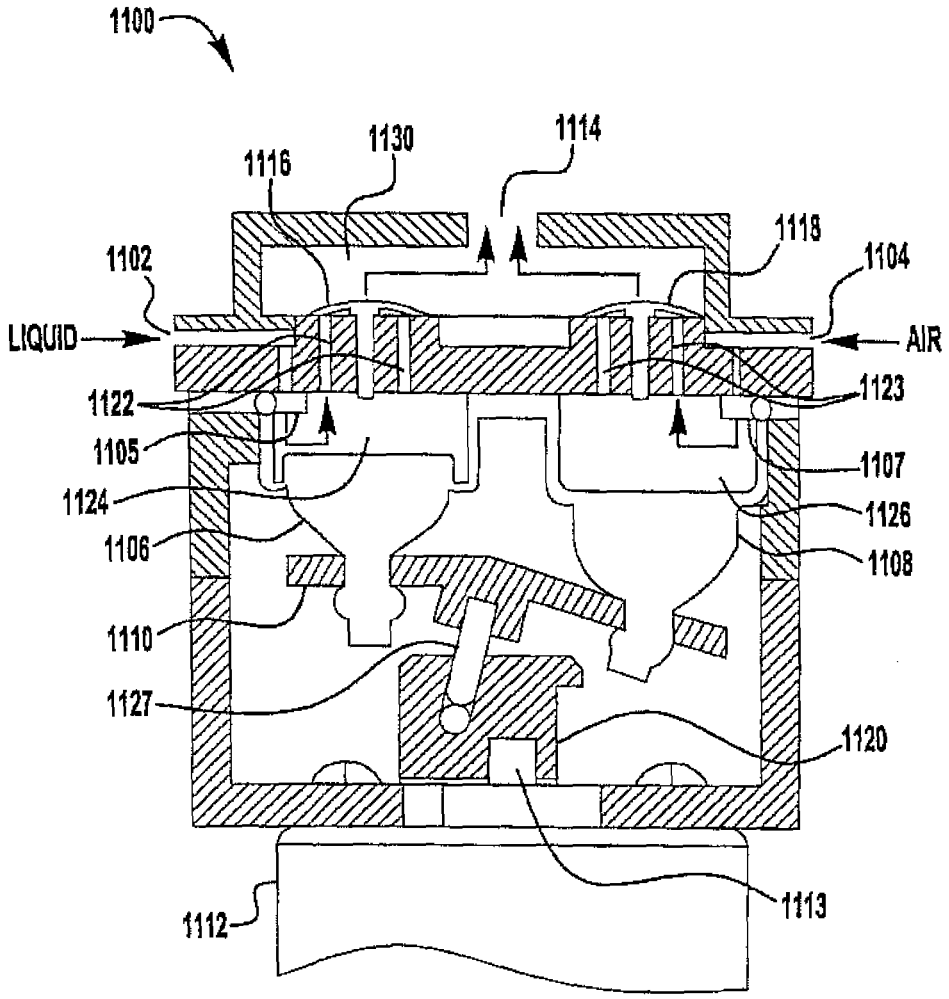
FIG. 11 is a cross-sectional view of another exemplary embodiment of a sequentially activated multi-diaphragm foam pump.

FIG. 11 is a cross-sectional view of another exemplary embodiment of a sequentially activated multi-diaphragm foam pump 1100. The sequentially activated multi-diaphragm foam pump 1100 includes a motor 1112, a motor shaft 1113, a wobble plate 1110, a wobble plate pin 1127 an eccentric wobble plate drive 1120, a liquid pump diaphragm 1106, two air pump diaphragms 1108 (only one is shown), mixing chamber 1130, and pump outlet 1114. The motor 1112 drives the motor shaft 1113, which causes the motor shaft 1113 to rotate. The rotation of the motor shaft 1113 causes the eccentric wobble plate drive 1120 to rotate, and rotation of the eccentric wobble plate drive 1120 causes the wobble plate pin 1127 to move along a circular path, which causes the wobble plate 1110 to undulate. In some embodiments, wobble plate 314 includes a ball 1128 that rides in a socket (not shown) on the pump housing and wobble plate pin 127 extends outward and connects to an eccentric wobble plate actuator 1120 that causes the pin to move along a circular path which causes the wobble plate 1110 to undulate. As the wobble plate 1110 undulates, the ends connected to the three pump diaphragms 1106, 1108 move in upward and downward motions, and the three pump diaphragms 1106, 1108 are compressed sequentially. One sequence of operation of the mixing pump 1100 includes one pump by each of the three pump diaphragms 1106, 1108. The liquid pump diaphragm 1106 operates first in the cycle of operation, followed by sequential distributions by the two air pump diaphragms 1108.

Similar to the embodiments described above, during operation, the liquid pump diaphragm 1106 expands and contracts to pump liquid, and the air pump diaphragms 1108 (only one is shown) expand and contract to pump air. The expansion of the liquid pump diaphragm 1106 opens the liquid inlet valve 1105 and allows liquid, such as, for example, soap or sanitizer to enter liquid pump chamber 1124 through liquid inlet 1102. The expansion of the air pump diaphragms 1108 opens the air inlet valves 1107 (only one is shown) and allows air to enter air pump chambers 1126 (only one is shown) through air inlets 1104. Circular movement of the wobble plate pin 1127 causes the ends of the wobble plate 1110 to sequentially undulate. The undulation causes liquid pump diaphragm to compress, which causes liquid outlet valve 1116 to open, and liquid to flow into the mixing chamber 1130 through liquid outlet apertures 1122. Subsequently, one of the air pump diaphragms 1108 is compressed by the undulating wobble plate 1110, which causes air outlet valve 1118 to open, and air to flow the mixing chamber 1130 through air outlet apertures 1123. Then, the other air pump diaphragm (not shown) will compress and pump air into mixing chamber 1130. The air and liquid soap or sanitizer mix in the mixing chamber 1130 to create a foam mixture. The foam mixture exits the mixing pump 1100 through pump outlet 1114.

Figure 12:
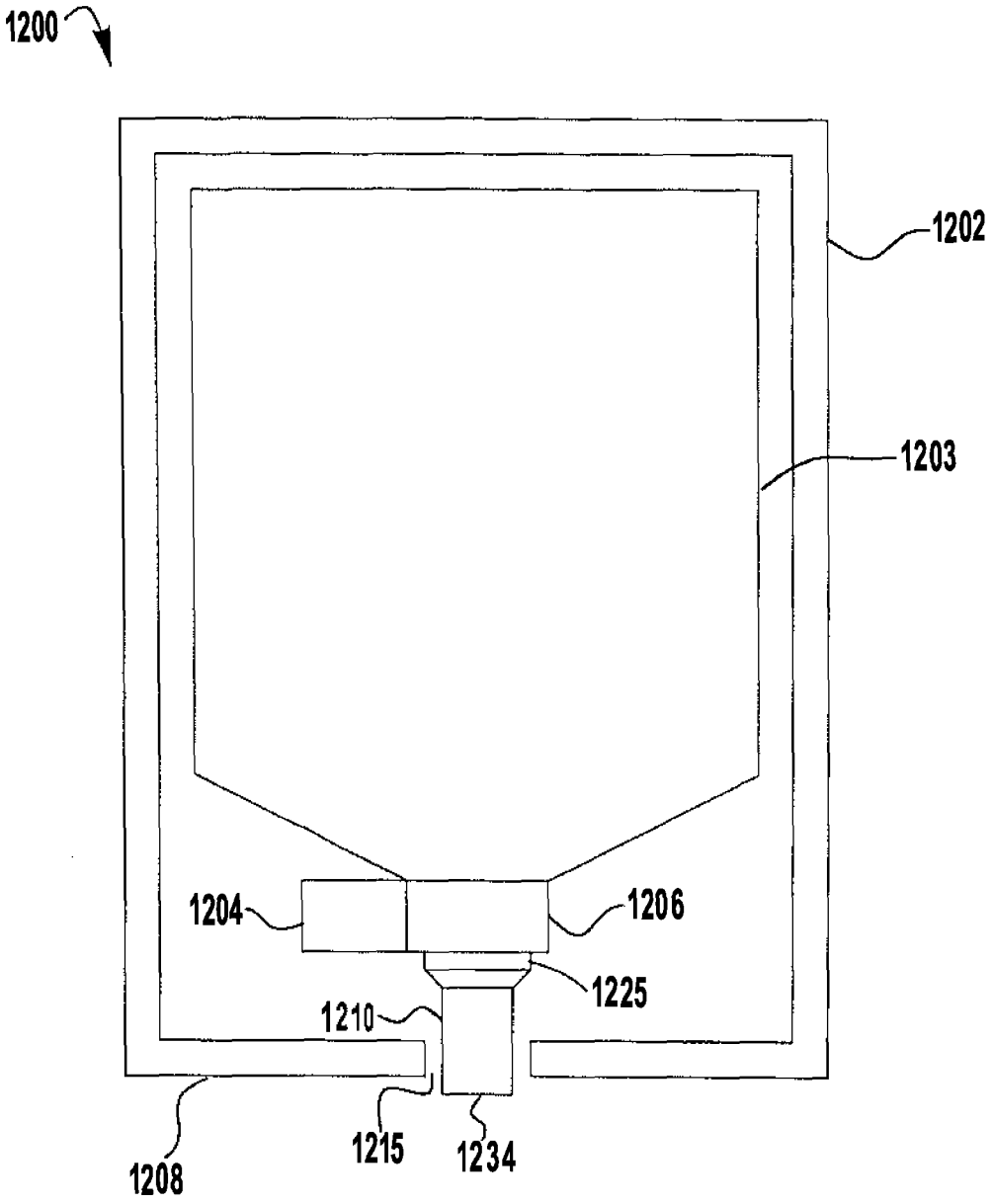
FIG. 12 is another exemplary embodiment of a foam dispenser.

FIG. 12 is another exemplary embodiment of a foam dispenser 1200. The foam dispenser 1200 includes a housing 1202, a collapsible container 1203, an actuator 1204, a foam pump 1206, a foam cartridge 1210, and a nozzle 1234. The foam dispenser 1200 may be a wall-mounted system, a counter-mounted system, an un-mounted portable system movable from place to place, or any other kind of dispenser system. The collapsible container 1203 contains a foamable liquid, such as a soap, a sanitizer, a lotion, a cleanser, a disinfectant or the like. The actuator 1204 includes one or more parts that cause the foam dispenser 1200 to move liquid, air and/or foam. Actuator 1204 is generically illustrated because there are many different kinds of pump actuators 1204 which may be employed in dispenser 200. For example, actuator 1204 may be a manual lever, a manual pull bar, a manual push bar, a manual rotatable crank, an electrically activated actuator or any other means for actuating foam pump 1206. An electronic actuators may include a sensor (not shown) an electronic control board (not shown), a power source (not shown) and a motor 1204 such, as, for example, those shown in FIG. 2 and described above, to provide for a hands-free dispenser system with touchless operation.

The foam pump 1206 is generically illustrated because there are many different kinds of foam pumps 1206 which may be employed in foam dispensers 1200. For example, the foam pump disclosed in U.S. Published Patent Application No. 2014/0367419 filed on Jun. 13, 2014 and entitled Foam Cartridges, Pumps, Refill Units And Foam Dispensers Utilizing the Same and U.S. Pat. No. 8,272,539 filed on Dec. 3, 2008 and entitled Angled Slot Foam Dispenser, which are incorporated by reference in their entirety, may be used in dispenser 100, or dispenser 1200. Moreover, exemplary embodiments of sequentially activated multi-diaphragm foam pumps are described in detail above, and may be used in foam dispenser 100 or 1200.

Figure 13:
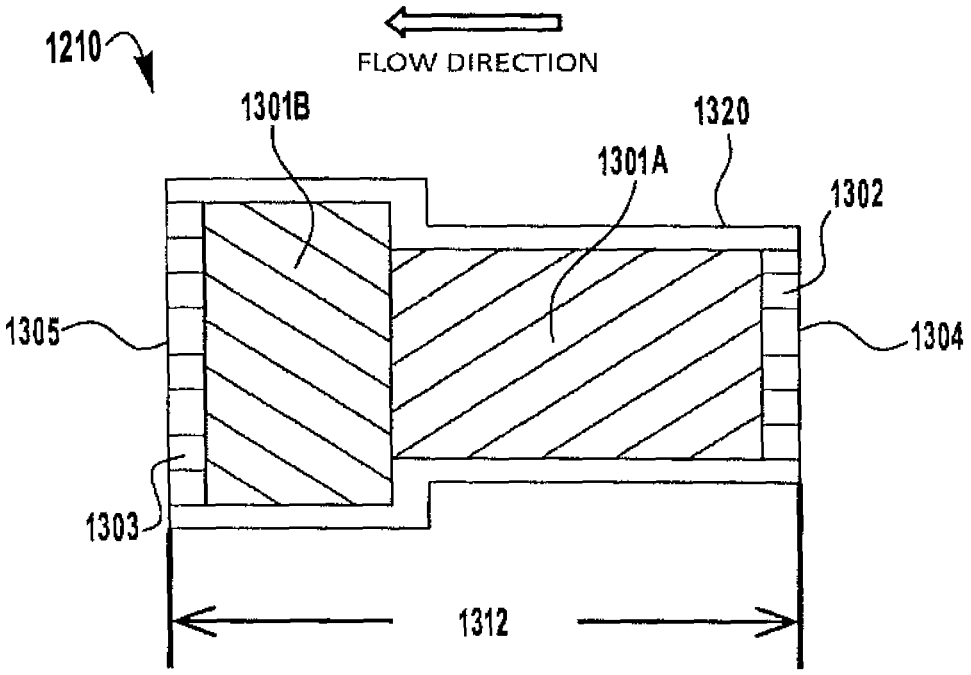
FIG. 13 is an exemplary embodiment of an improved foaming cartridge for a foam dispenser.

The foam pump 1206 is in fluid communication with the container 1203 and an air inlet (not shown). The foam pump 1206 may be secured to the container 1203 by any means, such as, for example, a threaded connection, a welded connection, a quarter turn connection, a snap fit connection, a clamp connection, a flange and fastener connection, or the like. The foam pump 1206 is activated by actuator 1204, and the foam pump 1206 pumps liquid and air through mixing chamber 1225 and foam cartridge 1210. The foam cartridge 1210 is in fluid communication with the mixing chamber 1225. Foaming media are retained within the foam cartridge 1210. The foaming media generate foam from the foamable liquid and air mixture. Some embodiments are especially well suited for enhanced foaming of foamable liquids containing alcohol. In an exemplary embodiment, the foaming media contains at least two sponges, an upstream sponge 1301A (FIG. 13) and a downstream sponge 1301B (FIG. 13). In the exemplary embodiment, the upstream sponge 1301A has a higher porosity than the downstream sponge 1301B.

FIG. 13 is a cross-section of an exemplary foam cartridge 1210 for a foam dispenser 1200. The foam cartridge 1210 includes a housing 1320 and a foaming stage 1312 with four foaming members, 1304, 1301A, 1301B, 1303. Housing 1320 has a first cross-sectional shape having a first diameter around the upstream sponge 1301A and a second cross-sectional shape having a second diameter around the downstream sponge 1301B. In the exemplary embodiment the second diameter is larger than the first diameter. The larger diameter of the housing 1320 and downstream sponge 1301B allow the foam/air mixture passing through the upstream sponge 1301A to expand into a larger area creating additional mixing of the air and liquid. Two of the four foaming members are sponges 1301A, 1301B. In the exemplary embodiment, the first foaming member is an inlet screen 1302. The second foaming member is upstream sponge 1301A. The third foaming member is downstream sponge 1301B. The fourth foaming member is outlet screen 1303. A mixture of air and liquid enters the foam cartridge 1210 at inlet 1304 and is dispensed as rich foam from outlet 1305. The process through foam cartridge 1210, begins after the mixture of air and liquid enters the inlet 1304, the mixture of air and liquid travels through the inlet screen 1302, which starts to enhance the foam. Next, the mixture of air and liquid travels through upstream sponge 1301A. Then, the mixture of air and liquid travels through downstream sponge 1301B. Finally, the mixture of air and liquid travels through outlet screen 1303 before exiting the foaming cartridge 1210 through outlet 1305 as rich foam. Foam cartridge 1210 may include a single foaming stage 1312 or several foaming stages. Also, the foaming cartridge 1210 may include several foaming members, with several different characteristics and configurations, disposed in the one or more foaming stages 1312.

The configuration of the foaming members in the foam cartridge 1210 may vary in different embodiments. In some embodiments, as shown in FIG. 13, the upstream sponge 1301A may be adjacent to the downstream sponge 1301B. In another embodiment, a space may exist between the upstream sponge 1301A and the downstream sponge 1301B. In another exemplary embodiment, a foaming member may be disposed between the upstream sponge 1301A and the downstream sponge 1301B. In some embodiments, there is a space between two or more of the foaming members, and in some embodiments, there is a space between three or more of the foaming members. In some embodiments, there is a space between each of the foaming members.

In this exemplary embodiment, the foaming members include screens and sponges. Exemplary foaming members include screens (1302, 1303), sponges 1301A, 1301B, other porous members (not shown), baffles (not shown), or the like. In the case of only two foaming members, some embodiments, include an upstream 1301A and downstream sponge 1301B. In some embodiments, there may be several foaming stages in series with one another, and each includes at least two sponges 1301A, 1301B.

The characteristics of the foaming members in the foam cartridge 1210 may vary in different embodiments. In some embodiments, sponges 1301A, 1301B may be made of polyurethane reticulated foam. However, in other embodiments the sponges 401 may be made of reticulated polyester, reticulated polyether or polyether open pore foam. In some embodiments, the upstream sponge 1301A and downstream sponge 1301B may have the same porosities. In some embodiments, the upstream sponge 1301A and the downstream sponge 1301B may have different porosities. In some embodiments, the upstream sponge 1301A has a higher porosity than the downstream sponge 1301B. In some embodiments, the upstream sponge 1301A has a lower porosity than the downstream sponge 1301B. The porosity of sponges 1301A, 1301B may be defined as a function of the pores per inch of the sponges 1301A, 1301B and the amount of compression of the sponges 1301A, 1301B.

In some embodiments, the sponges 1301A, 1301B have the same amount of pores per inch and the porosity of the sponges 1301A, 1301B may be a function of the amount of compression of the sponges 1301A, 1301B. In some embodiments, the sponges 1301A, 1301B have between about 50 pores per inch and about 90 pores per inch. In some embodiments, the upstream sponge 1301A is compressed to between about 30 percent and about 50 percent of its uncompressed or relaxed state, and the downstream sponge 1301B is compressed to between about 60 percent and about 80 percent of its uncompressed or relaxed state. Accordingly, in this exemplary embodiment, the upstream sponge 1301A has a higher porosity than the downstream sponge 1301B because the upstream sponge 1301A is less compressed than the downstream sponge 1301B. Sponges 1301A, 1301B may have the same amount of pores per inch or different amounts of pores per inch, and sponges 1301A, 1301B may have the same amount of compression or a different amount compression. In addition, sponges 1301A, 1301B may have the same firmness or different firmness. Other materials that may be suitable for replacement of the sponges may include fabric felts, metal fibers, wax dipped paper filters etc.

In some embodiments, sponges 1301A, 1301B may be defined by firmness. Firmness is measure in pounds per square inch to cause a 25% deflection in the foam from its normal thickness. In some embodiments, the firmness is in the range of about 0.1 to about 2 pounds per square inch to achieve 25% deflection. In some embodiments, the sponges have a density in pounds/cubic foot, and have a density of less that about 4, including less than about 3.5, including less than about 3, including less than about 2.5.

Furthermore, in embodiments that include an inlet screen 1302 and an outlet screen 1303, the characteristics of the screens (1302, 1303) may vary. In some embodiments, the inlet screen 1302 have less threads per inch than outlet screen 1303, or vice versa. In an exemplary embodiment, the inlet screen 1302 has about 100 threads per inch, and the outlet screen 1303 has between about 150 threads per inch and about 200 threads per inch. However, screens 1302, 1303 may have the same threads per inch. A foaming cartridge 1210 may have several screens 1302, 1303 in different locations throughout the foaming cartridge 210, and screens 1302, 1303 may have many variations in the amount of threads per inch. In addition, the screens 1302, 1303 and sponges 1301A, 1301B may be configured with spaces between the foaming members, with open spaces between two or more foaming members. The foaming members may be arranged as shown with a screen 1302 followed by sponges 1301A and 1301B followed by screen 1303, or arranged in various different orders.

Figure 14:
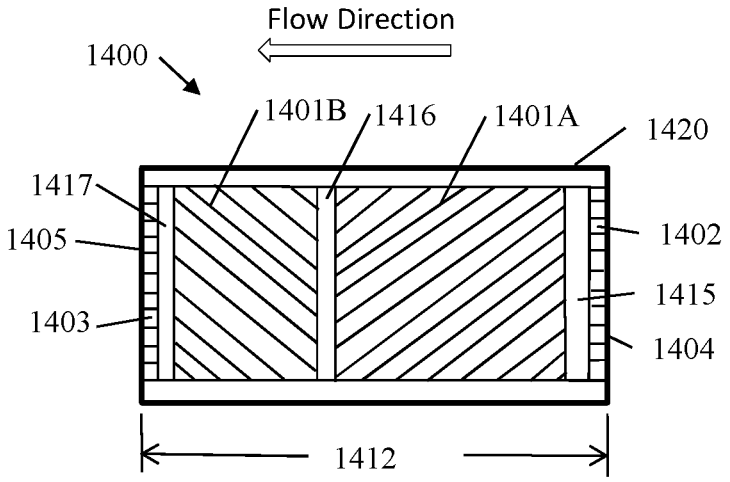
FIG. 14 is another exemplary embodiment of an improved foaming cartridge for a foam dispenser.

FIG. 14 is a cross-section of another exemplary foam cartridge 1400 for a foam dispenser 1200, which may be used in lieu of, or in combination with, foam cartridge 1210. The foam cartridge 1400 includes a housing 1420 and a foaming stage 1412 with four foaming members. Two of the four foaming members are sponges 1401A, 1401B. In this exemplary embodiment, all of the foaming members have about the same diameter and housing 1420 has a cylindrical shape with a constant diameter. In the exemplary embodiment, the first foaming member is an inlet screen 1402. The second foaming member is upstream sponge 1401A. The third foaming member is downstream sponge 1401B. The fourth foaming member is outlet screen 1403. A mixture of air and liquid enters the foam cartridge 1400 at inlet 1404 and is dispensed as rich foam from outlet 1405. The process begins after the mixture of air and liquid enters the inlet 1404 and travels through the inlet screen 1402, and into space 1415. Next, the mixture of air and liquid travels through upstream sponge 1401A and into space 1416. Then, the mixture of air and liquid travels through downstream sponge 1401B and into space 1417. Finally, the mixture of air and liquid travels through outlet screen 1403 and exits the foaming cartridge 1400 through outlet 1405 as rich foam. As the mixture passes through the foaming members and into the spaces, the area expands allowing for a more violent mixture of the liquid and air. Foam cartridge 1400 may include a single foaming stage 1412 or several foaming stages. Also, the foaming cartridge 1400 may include several foaming members, with several different characteristics and configurations, disposed in the one or more foaming stages 1412.

The configuration of the foaming members in the foam cartridge 1400 may vary in different embodiments. In some embodiments, the upstream sponge 1401A may be adjacent to the downstream sponge 1401B. In some embodiments, a space may exist between the upstream sponge 1401A and the downstream sponge 1401B. In some embodiments, other foaming members may be disposed between the upstream sponge 1401A and the downstream sponge 1401B.

In this exemplary embodiment, the foaming members include screens and sponges. In some embodiments the foaming members may include screens (1402, 1403), sponges 1401A, 1401B, other porous members (not shown), baffles (not shown), or the like. In the case of only two foaming members, some embodiments, include the upstream and downstream sponges 1401A, 1401B. In some embodiments, there are two or more foaming stages, and each includes at least two sponges 1401A, 1401B.

The characteristics of the foaming members in the foam cartridge 1400 may vary in different embodiments. In some embodiments, sponges 1401A, 1401B may be made of polyurethane reticulated foam. In some embodiments the sponges 401 may be made of reticulated polyester, reticulated polyether or polyether open pore foam or the like. In some embodiments, the upstream sponge 1401A and downstream sponge 1401B may have the same porosities. In some embodiments, the upstream sponge 1401A and the downstream sponge 1401B may have different porosities. In some embodiments, the upstream sponge 1401A has a higher porosity than the downstream sponge 1401B. In some embodiments, the upstream sponge 1401A has a lower porosity than the downstream sponge 1401B. The porosity of sponges 1401A, 1401B may be defined as a function of the pores per inch of the sponges 1401A, 1401B and the amount of compression of the sponges 1401A, 1401B.

In some embodiments, the sponges 1401A, 1401B have the same amount of pores per inch and the porosity of the sponges 1401A, 1401B may be a function of the amount of compression of the sponges 1401A, 1401B. In some embodiments, the sponges 1401A, 1401B have between about 50 pores per inch and about 90 pores per inch. In some embodiments, the upstream sponge 1401A is compressed to between about 30 percent and about 50 percent of its uncompressed or relaxed state, and the downstream sponge 1401B is compressed to between about 60 percent and about 80 percent of its uncompressed or relaxed state. Accordingly, in this exemplary embodiment, the upstream sponge 1401A has a higher porosity than the downstream sponge 1401B because the upstream sponge 1401A is less compressed than the downstream sponge 1401B. Sponges 1401A, 1401B may have the same amount of pores per inch or different amounts of pores per inch, and sponges 1401A, 1401B may have the same amount of compression or a different amount compression. In addition, sponges 1401A, 1401B may have the same firmness or different firmness. Other materials that may be suitable for replacement of the sponges may include fabric felts, metal fibers, wax dipped paper filters etc.

In some embodiments, sponges 1401A, 1401B may be defined by firmness. Firmness is measure in pounds per square inch to cause a 25% deflection in the foam from its normal thickness. In some embodiments, the firmness is in the range of about 0.1 to about 2 pounds per square inch. In some embodiments, the sponges have a density in pounds/cubic foot, and have a density of less that about 4, including less than about 3.5, including less than about 3, including less than about 2.5. In some embodiments, the upstream sponge 1401A and downstream sponge 1401B may have the same firmness. In some embodiments, the upstream sponge 1401A and the downstream sponge 1401B may have different firmness. In some embodiments, the upstream sponge 1401A has a higher firmness than the downstream sponge 1401B. In some embodiments, the upstream sponge 1401A has a lower firmness than the downstream sponge 1401B.

Furthermore, in embodiments that include an inlet screen 1402 and an outlet screen 1403, the characteristics of the screens (1402, 1403) may vary. In some embodiments, the inlet screen 1402 have less threads per inch than outlet screen 1403, or vice versa. In an exemplary embodiment, the inlet screen 1402 has about 100 threads per inch, and the outlet screen 1403 has between about 150 threads per inch and about 200 threads per inch. However, screens 1402, 1403 may have the same threads per inch. A foaming cartridge 1400 may have several screens 1402, 1403 in different locations throughout the foaming cartridge 210, and screens 1402, 1403 may have many variations in the amount of threads per inch. In addition, the screens 1402, 1403 and sponges 1401A, 1401B may be configured with spaces between the foaming members (as shown), with open spaces between two or more foaming members. The foaming members may be arranged as shown with a screen 1402 followed by space 1415, followed by sponge 1401A followed by space 1416, followed by sponge 1401B, followed by space 1417 followed by screen 1403, or arranged in various different orders.

While the above-mentioned embodiments show and describe wall mounted and above counter mounted dispensers, the foam cartridges 1210, 1400 work very well with counter mount dispensers. An exemplary embodiment is shown and described in U.S. Pat. No. 8,544,698 filed on Mar. 26, 2007 and entitled Foam Dispenser with Stationary Dispense Tube which is incorporated herein in its entirety by reference.

Alcohol is a deforming agent and it is difficult to create a rich or stable foam. It has been discovered that exemplary embodiments of foaming cartridges 1210, 1400 with two sponges having different porosities when used with foamable alcohol compositions and the sequentially activated diaphragm foam pump described in detail above provide a superior foam output over conventional piston foam pumps. It has been discovered that exemplary embodiments of foaming cartridges 1210, 1400 with two sponges having different firmness when used with foamable alcohol compositions and the foam sequentially activated diaphragm foam pump described above provide a superior foam output over conventional piston foam pumps. In addition, it has also been discovered that the exemplary foaming cartridges improve the quality of foam in alcohol foam products when used with mini-foam pumps that have air and liquid pistons.

While the present invention has been illustrated by the description of embodiments thereof, and while the embodiments have been described in considerable detail, it is not the intention of the applicants to restrict or in any way limit the scope of the appended claims to such detail. Additional advantages and modifications will readily appear to those skilled in the art. Moreover, elements described with one embodiment may be readily adapted for use with other embodiments. Therefore, the invention, in its broader aspects, is not limited to the specific details, the representative apparatus, and illustrative examples shown and described. Accordingly, departures may be made from such details without departing from the spirit or scope of the applicants' general inventive concept.

The invention claimed is:

1. A foam dispenser having foaming cartridge for dispensing an formulation containing alcohol comprising:

a dispenser housing;

a container containing a formulation containing alcohol;

a multi-diaphragm sequentially activated pump located within the housing having at least one fluid pumping diaphragm in fluid communication with the formulation containing alcohol and at least two air pumping diaphragms;

a mixing chamber in fluid communication with an outlet of the at least one fluid pump diaphragm and the at least two air pump diaphragms;

a foaming cartridge in fluid communication with the mixing chamber;

the foaming cartridge having a housing;

a foaming stage having two or more mix media;

wherein at least two of the mix media are sponges, one being an upstream sponge and one being a downstream sponge;

wherein at least two sponges have different porosities.

2. The foam dispenser of claim 1 wherein the upstream sponge has a higher porosity than the downstream sponge.

3. The foam dispenser of claim 1 wherein two of the mix media include an inlet screen and an outlet screen.

4. The foam dispenser of claim 1 wherein four mix media are located within the foaming stage.

5. A foam cartridge for a foam dispenser comprising:

a housing;

a foaming stage having four mix media;

wherein at least two of the mix media are sponges wherein the at least two sponges have different porosities;

wherein the four mix media include an inlet screen, an upstream sponge, a downstream sponge, and an outlet screen;

wherein the inlet screen is adjacent to the upstream sponge;

wherein the upstream sponge is adjacent to the downstream sponge; and wherein the downstream sponge is adjacent to the outlet screen.

6. A foam dispenser comprising:

a housing;

a motor;

a foam pump wherein the foam pump includes:

a wobble plate;

a plurality of pump diaphragms wherein each pump diaphragm is connected to the wobble plate;

a mixing chamber;

at least one foaming stage disposed in a housing;

two or more mix media located within the foaming stage;

wherein at least two of the mix media are sponges, including an upstream sponge and a downstream sponge;

wherein the upstream sponge and the downstream sponge have different porosities; and an outlet for dispensing foam.

7. The foam dispenser of claim 6 wherein the upstream sponge has a higher porosity than the downstream sponge.

8. The foam dispenser of claim 6 further comprising mix media in the form of an inlet screen and an outlet screen.

9. A foam dispenser comprising:

a housing;

a motor;

a sequentially activated multi-diaphragm foam pump having:

a liquid pump diaphragm for pumping liquid into a mixing chamber;

a first air pump diaphragm for pumping air into the mixing chamber; and a second air pump diaphragm for pumping air into the mixing chamber;

wherein the liquid pump diaphragm, the first air pump diaphragm and the second air pump diaphragm are compressed sequentially to pump liquid and air;

a foam cartridge downstream of the mixing chamber wherein the foam cartridge includes;

at least one foaming stage;

two or more mix media located within the foaming stage;

wherein at least two of the mix media are sponges comprising an upstream sponge and a downstream sponge;

wherein the upstream sponge and the downstream sponge have different porosities; and a foam outlet located downstream of the foam cartridge.

10. The foam dispenser of claim 9 wherein the sequentially activated multi-diaphragm foam pump has a longitudinal axis and the liquid pump diaphragm, the first air pump diaphragm and the second air pump diaphragm are concentric about the longitudinal axis.

11. The foam dispenser of claim 9 wherein the liquid pump diaphragm pumps sanitizer.

12. The foam dispenser of claim 9 wherein the upstream sponge has a higher porosity than the downstream sponge.

13. The foam dispenser of claim 9 wherein at least two mix media include an inlet screen and an outlet screen.

14. The foam dispenser of claim 13 wherein the inlet screen has less threads per inch than the outlet screen.

15. The foam dispenser of claim 13 wherein the inlet screen has about 100 threads per inch, and the outlet screen has between about 150 threads per inch and about 200 threads per inch.

16. The foam dispenser of claim 9 wherein the upstream sponge has a higher porosity than the downstream sponge.

17. The foam dispenser of claim 9 wherein the upstream sponge has between about 50 to about 90 pores per inch.

18. The foam dispenser of claim 9 wherein the foam cartridge includes a housing and upstream sponge is compressed to between about 30-50% of its uncompressed state by the housing.

19. The foam dispenser of claim 9 wherein the downstream sponge has between about 50 to about 90 pores per inch.

20. The foam dispenser of claim 9 wherein the foam cartridge includes a housing and downstream sponge is compressed to between about 60-80% of its uncompressed state by the housing.

* * * * *